US010514042B2

(12) United States Patent
Lopes

(10) Patent No.: US 10,514,042 B2
(45) Date of Patent: Dec. 24, 2019

(54) DEBRIS REMOVING IMPELLER BACK VANE

(71) Applicant: Flow Control LLC., Beverly, MA (US)
(72) Inventor: Jeffrey D. Lopes, Gloucester, MA (US)
(73) Assignee: Flow Control LLC, Beverly, MA (US)

( * ) Notice: Subject to any disclaimer, the term of this patent is extended or adjusted under 35 U.S.C. 154(b) by 593 days.
(21) Appl. No.: 14/899,894
(22) PCT Filed: Jun. 23, 2014
(86) PCT No.: PCT/US2014/043660
§ 371 (c)(1),
(2) Date: Dec. 18, 2015
(87) PCT Pub. No.: WO2014/205439
PCT Pub. Date: Dec. 24, 2014
(65) Prior Publication Data
US 2016/0138605 A1 May 19, 2016

Related U.S. Application Data
(60) Provisional application No. 61/837,753, filed on Jun. 21, 2013.
(51) Int. Cl.
*F04D 1/00* (2006.01)
*F04D 7/04* (2006.01)
(Continued)
(52) U.S. Cl.
CPC ..... *F04D 29/242* (2013.01); *F04D 1/00* (2013.01); *F04D 7/045* (2013.01); *F04D 13/02* (2013.01);
(Continued)
(58) Field of Classification Search
CPC .. F04D 29/242; F04D 29/245; F04D 29/4206; F04D 29/2288; F04D 7/045; F05B 2250/15; F05D 2250/15
See application file for complete search history.

(56) References Cited
U.S. PATENT DOCUMENTS
2,028,783 A 1/1936 Jacobsen
2,245,035 A 6/1941 Hartman
(Continued)
FOREIGN PATENT DOCUMENTS
CA 2188138 3/2004
CN 101691873 A 4/2010
(Continued)
OTHER PUBLICATIONS
Catrakis, Haris J.. The Logarithmic Spiral: Mathematical Aspects and Modeling in Turbulence. Journal of Mathematics Research, [S.I], v. 3, n. 3, p. p3, Jul. 2011. ISSN 1916-9809.*
(Continued)

*Primary Examiner* — Ninh H. Nguyen
*Assistant Examiner* — Brian P Wolcott
(74) *Attorney, Agent, or Firm* — Ware, Fressola, Maguire & Barber LLP

(57) ABSTRACT
A pump features an impeller having a rotating disk with a front side and a back side. The impeller is arranged to rotate on a shaft with the front side nearest an inlet and the back side nearest a motor housing, so as to provide a main flow of liquid being pumped and a rear impeller flow of the liquid being pumped in an area between the back side of the impeller and the motor housing. The back side has a spiral-shaped vane configured to constantly sweep, and expel any debris from the area between the back side of the impeller and the motor housing. The spiral-shaped vane is formed as a curve that emanates from a central point defined by an axis of the impeller and gets progressively farther away as the curve revolves at least one complete revolution around the central point or axis.

19 Claims, 10 Drawing Sheets

Action of back vane on debris

(51) Int. Cl.

| | |
|---|---|
| ***F04D 13/02*** | (2006.01) |
| ***F04D 29/00*** | (2006.01) |
| ***F04D 29/10*** | (2006.01) |
| ***F04D 29/22*** | (2006.01) |
| ***F04D 29/24*** | (2006.01) |
| ***F04D 29/42*** | (2006.01) |
| ***F04D 29/70*** | (2006.01) |

(52) U.S. Cl.
CPC ..... *F04D 29/007* (2013.01); *F04D 29/2288* (2013.01); *F04D 29/245* (2013.01); *F04D 29/4206* (2013.01); *F04D 29/106* (2013.01); *F04D 29/2266* (2013.01); *F04D 29/708* (2013.01); *F05D 2250/15* (2013.01)

(56) References Cited

U.S. PATENT DOCUMENTS

| | | | | |
|---|---|---|---|---|
| 2,255,287 | A | | 9/1941 | Jacobsen |
| 2,361,521 | A | | 10/1944 | Yates |
| 2,882,829 | A | * | 4/1959 | Wade ..... F04D 29/2222 415/206 |
| 4,349,322 | A | * | 9/1982 | Stahle ..... F04D 29/586 415/112 |
| 4,410,337 | A | | 10/1983 | Gullichsen et al. |
| 4,664,592 | A | | 5/1987 | Grzina |
| 4,877,424 | A | | 10/1989 | Perkola et al. |
| 4,921,400 | A | | 5/1990 | Niskanen |
| 4,981,413 | A | | 1/1991 | Elonen et al. |
| 5,019,136 | A | | 5/1991 | Elonen et al. |
| 5,078,573 | A | | 1/1992 | Peroaho et al. |
| 5,114,310 | A | | 5/1992 | Haavik et al. |
| 5,116,198 | A | | 5/1992 | Vesala et al. |
| 5,151,010 | A | | 9/1992 | Vesala et al. |
| 5,152,663 | A | | 10/1992 | Peroaho et al. |
| 5,167,678 | A | | 12/1992 | Elonen et al. |
| 5,489,187 | A | | 2/1996 | Ray |
| 5,842,833 | A | | 12/1998 | Reponen et al. |
| 6,074,166 | A | | 6/2000 | Moddemeijer |
| 6,120,252 | A | | 9/2000 | Reponen et al. |
| 6,190,121 | B1 | | 2/2001 | Hayward et al. |
| 7,080,797 | B2 | | 7/2006 | Doering et al. |
| 7,125,221 | B2 | | 10/2006 | Dorsch et al. |
| 7,159,806 | B1 | | 1/2007 | Ritsema |
| 7,234,657 | B2 | | 6/2007 | Doering et al. |
| 8,105,017 | B2 | | 1/2012 | Dorsch et al. |
| 8,109,730 | B2 | | 2/2012 | Anderson |
| 8,221,070 | B2 | | 7/2012 | Baryshnikov |
| 2004/0136826 | A1 | | 7/2004 | Britt et al. |
| 2007/0274820 | A1 | * | 11/2007 | Lindskog ..... F04D 29/167 415/55.1 |
| 2009/0208336 | A1 | | 8/2009 | Lindskog |
| 2012/0051897 | A1 | | 3/2012 | Davis et al. |

FOREIGN PATENT DOCUMENTS

| | | | |
|---|---|---|---|
| CN | 102661282 | A | 9/2012 |
| DE | 10219616 | | 11/2003 |
| EP | 112462 | | 7/1986 |
| EP | 0330387 | | 2/1989 |
| EP | 0538212 | | 4/1993 |
| EP | 1344541 | A2 | 9/2003 |
| EP | 1147316 | | 3/2005 |
| EP | 1651869 | | 2/2008 |
| GB | 1063096 | | 3/1967 |
| GB | 1248873 | | 10/1971 |
| JP | 531301 | A | 1/1978 |
| JP | S53 1301 | A | 1/1978 |
| JP | S531301 | A1 * | 1/1978 |
| JP | 2005 214099 | A | 8/2005 |
| JP | 2005214099 | A | 8/2005 |
| WO | 2005012732 | | 2/2005 |
| WO | 2011139223 | | 11/2011 |
| WO | 2012009021 | | 1/2012 |

OTHER PUBLICATIONS

English language abstract of CN101691873.
English language abstract of CN102661282.
Haris J. Catrakis; "The Logarithmic Spiral: Mathematical Aspects and Modeling in Turbulence"; Journal of Mathematics Research; vol. 3, No. 3; Aug. 2011; pp. 3-11.
Franciscus Cornelis Visser, "On the Flow in Centrifugal Impellers"; 1996, pp. 1-11, University of Twente, Netherlands.
English language abstract of JP S53 1301A.
English language Abstract and translation of JPS531301A.
Visser, F. On the Flow in Centrifugal Impellers. University of Twente. The Hague, Netherlands. Feb. 15, 1996 [retrieved Sep. 29, 2014). Retrieved from the internet: <URL: http://doc.utwente.n1/32024/1/visser_thesis.pdf>. p. 1-99.
Catrakis, H. The Logarithmic Spiral: Mathematical Aspects and Modeling in Turbulence. Journal of Mathematics Research. vol. 3, No. 3. Aug. 2011 [retrieved on Sep. 29, 2014). Retrieved from the internet: <URL: http://ccsenet.org/journal/index.php/jmr/article/download/9746/8086>.
DE10219616 English Language Machine Translation (6 pages).
EP1651869 English Language Machine Translation (9 pages).
EP112462 English Language Machine Translation (4 pages).
English language Abstract of JP2005214099A.
USPTO Reference OA3 Form from foreign associate.

* cited by examiner

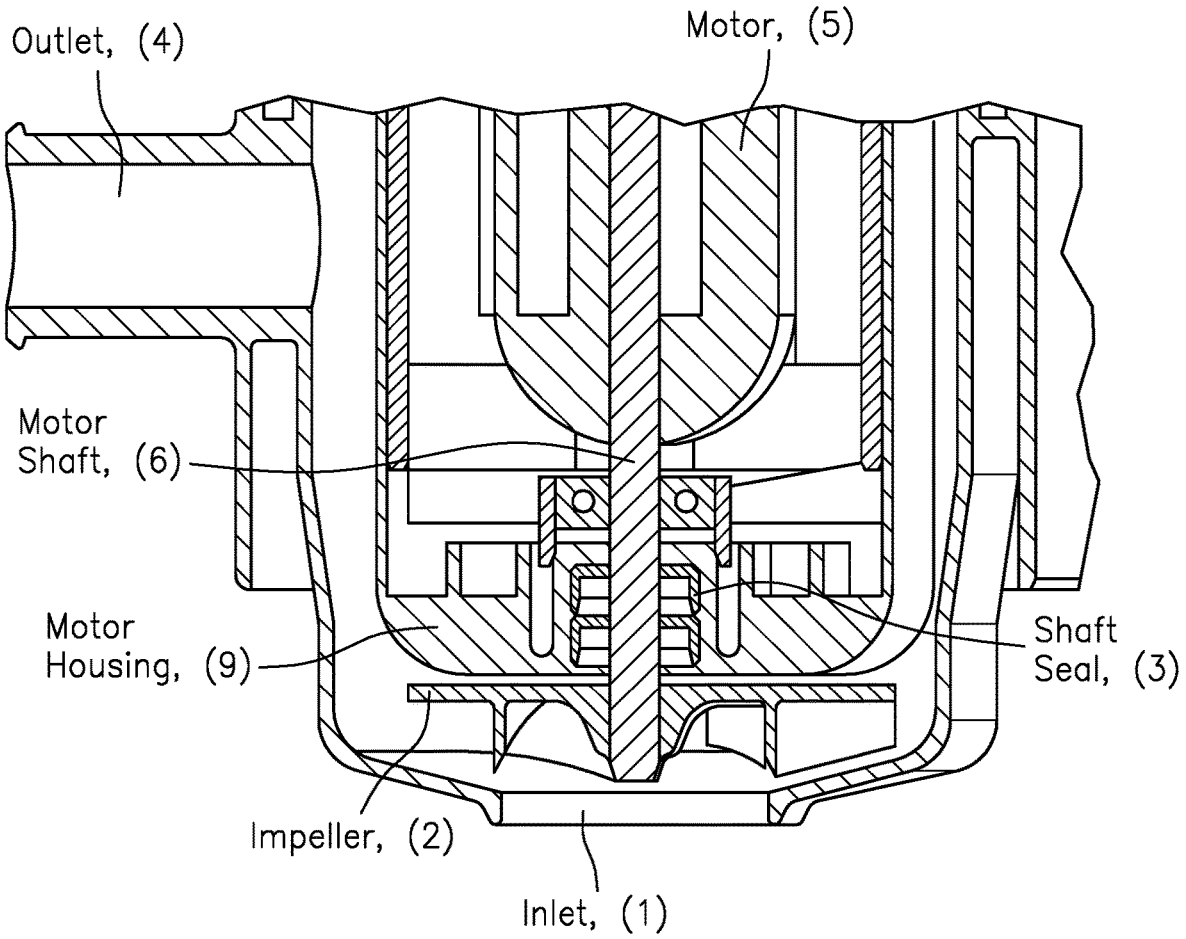
*FIG.* 1A:Typical Centrifugal Pump Configuration (PRIOR ART)

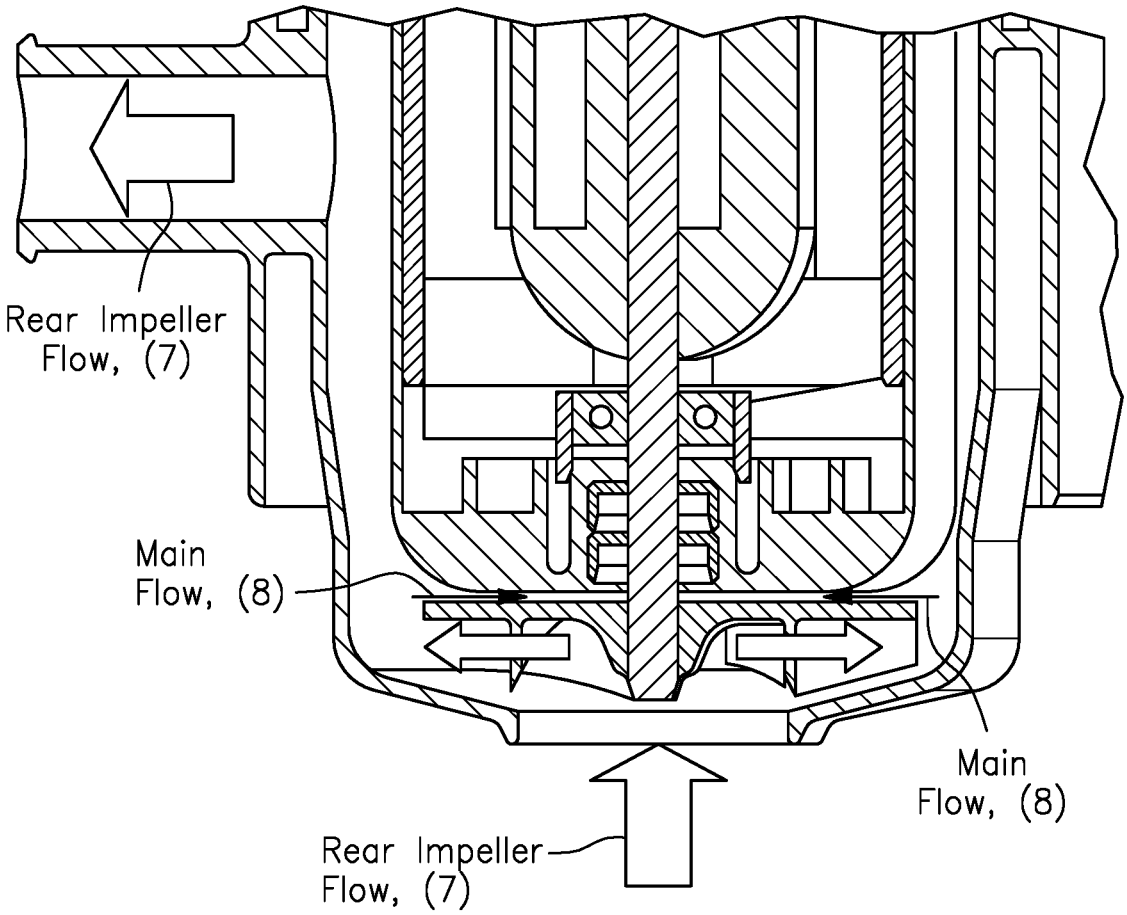
*FIG. 1B*: Flow in the pump
(PRIOR ART)

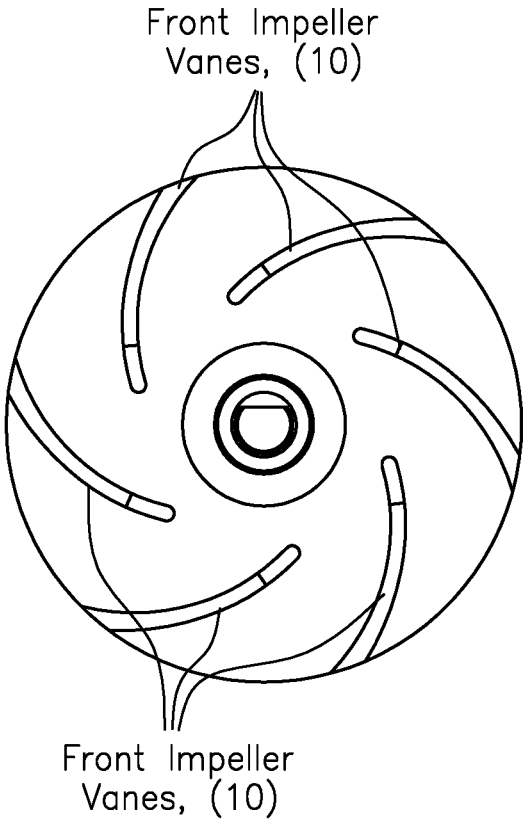
FIG. 1C(1)
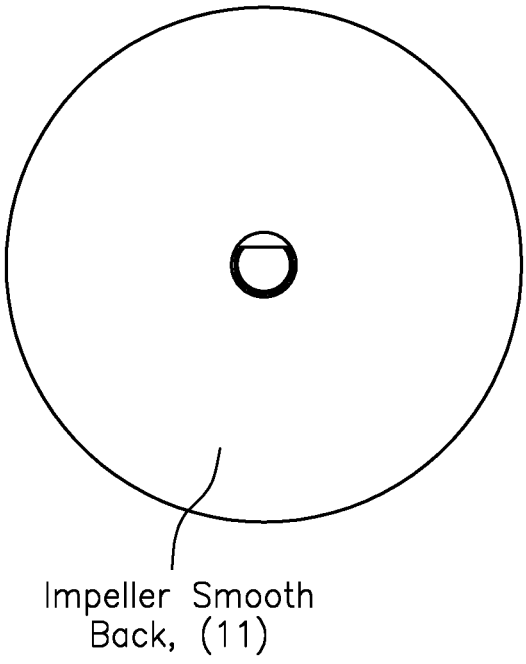
FIG. 1C(2)
FIG. 1C: Typical Impeller
(PRIOR ART)
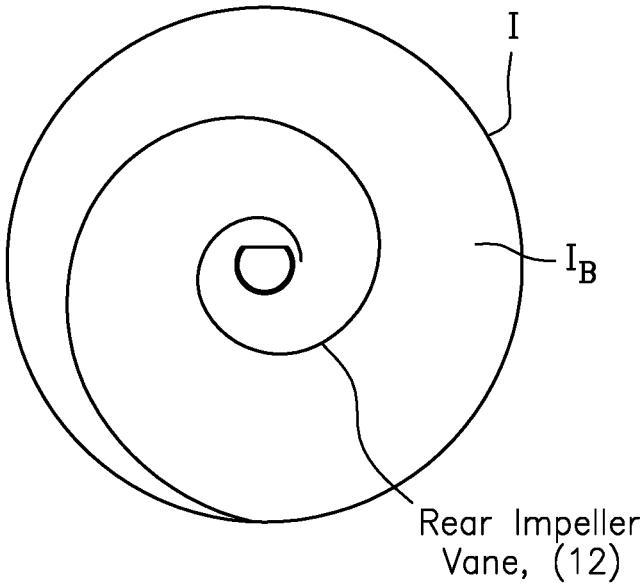
FIG. 2: Impeller with back vane

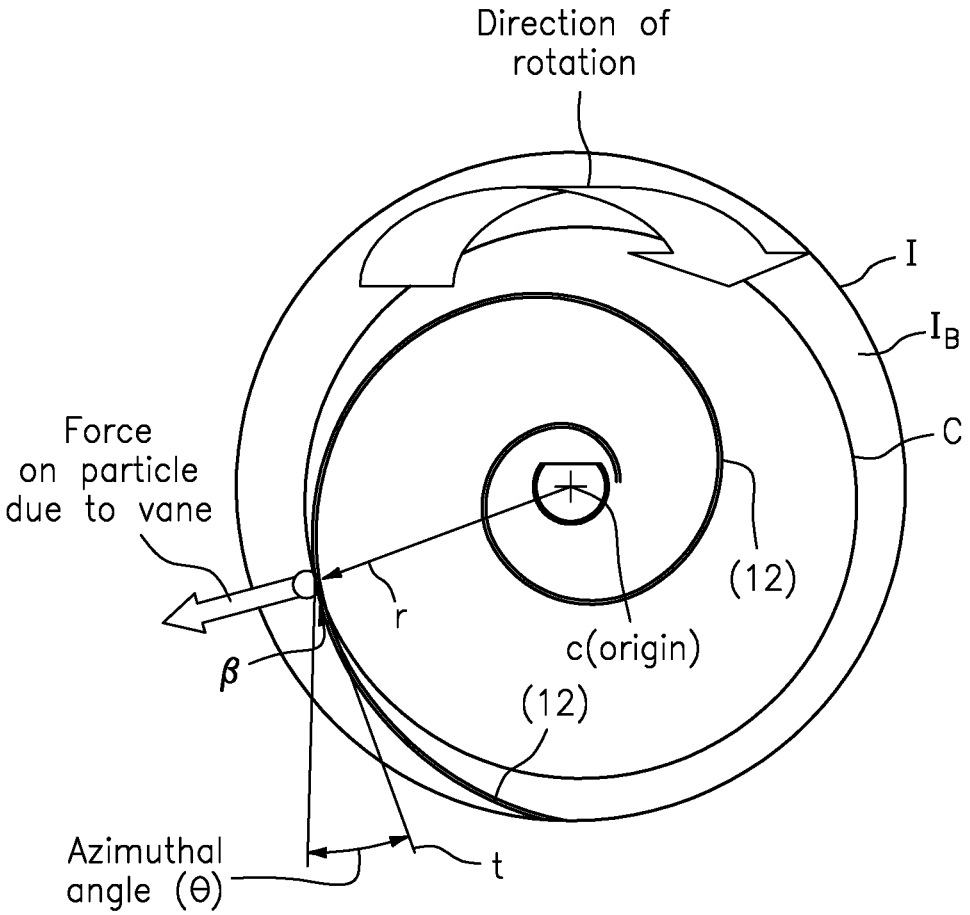
*FIG. 3*: Action of back vane on debris

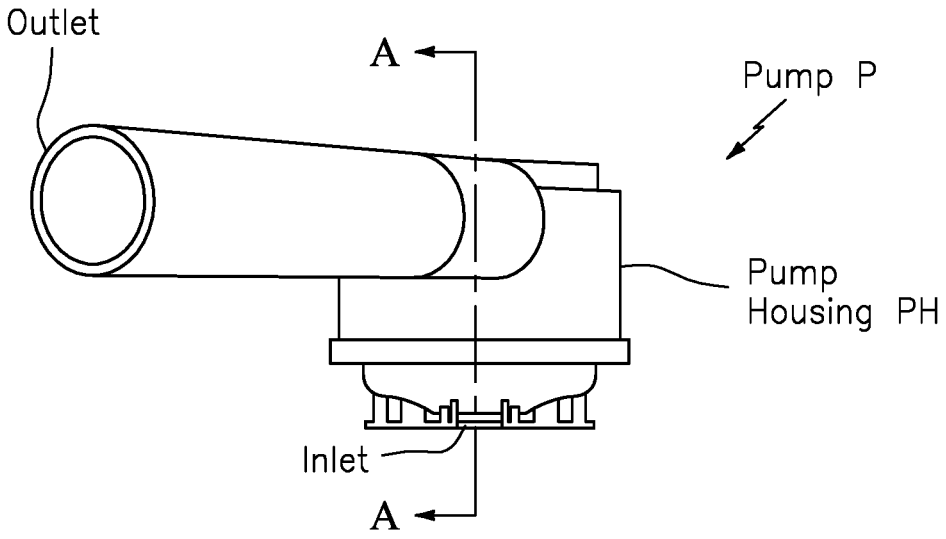
*FIG. 4*: Pump geometry with AA plane section

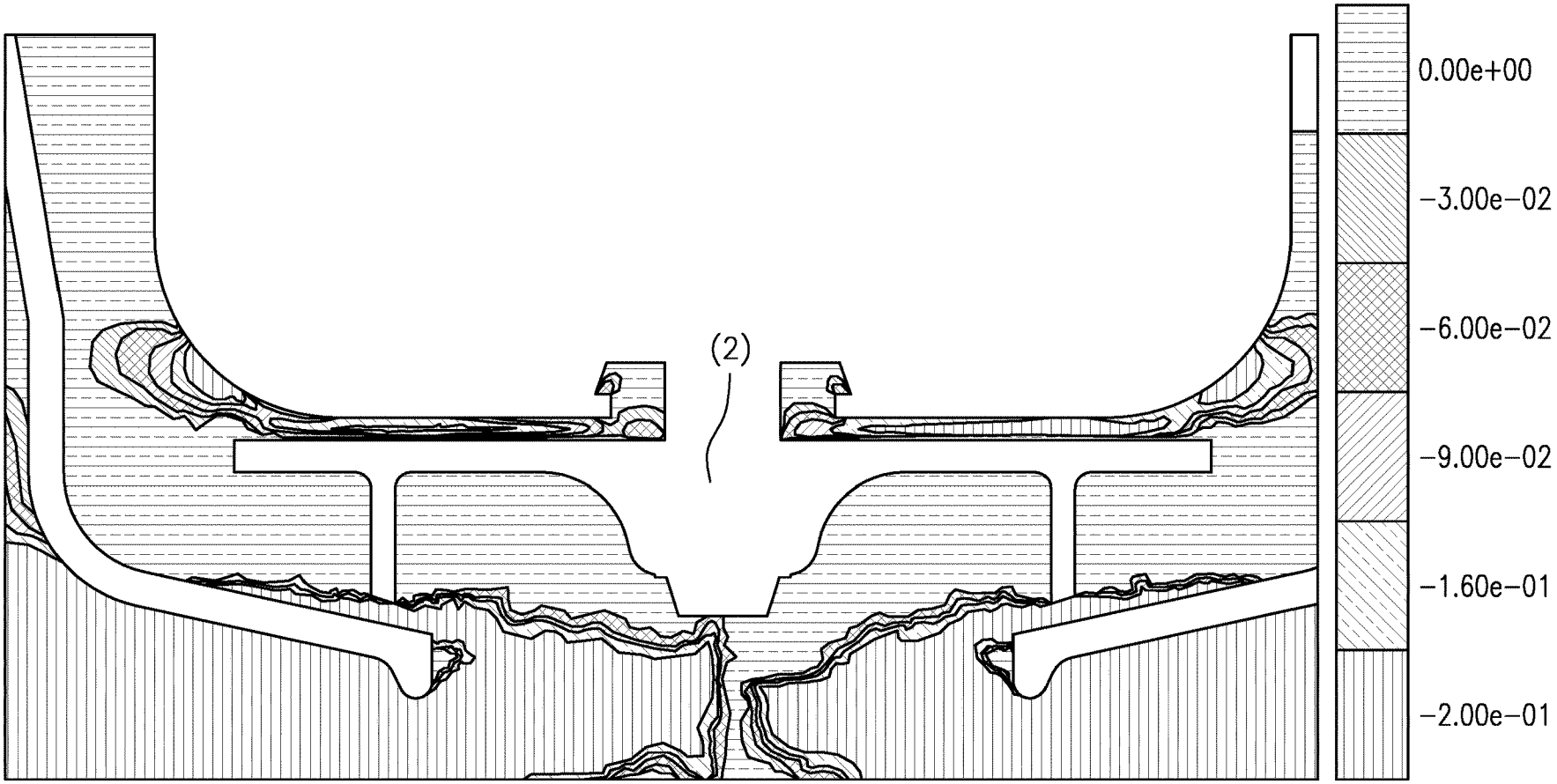
*FIG. 5A*: Case 1 (without vane)
*FIG. 5*: Diagrams of negative radial velocity (NRV) on Section AA

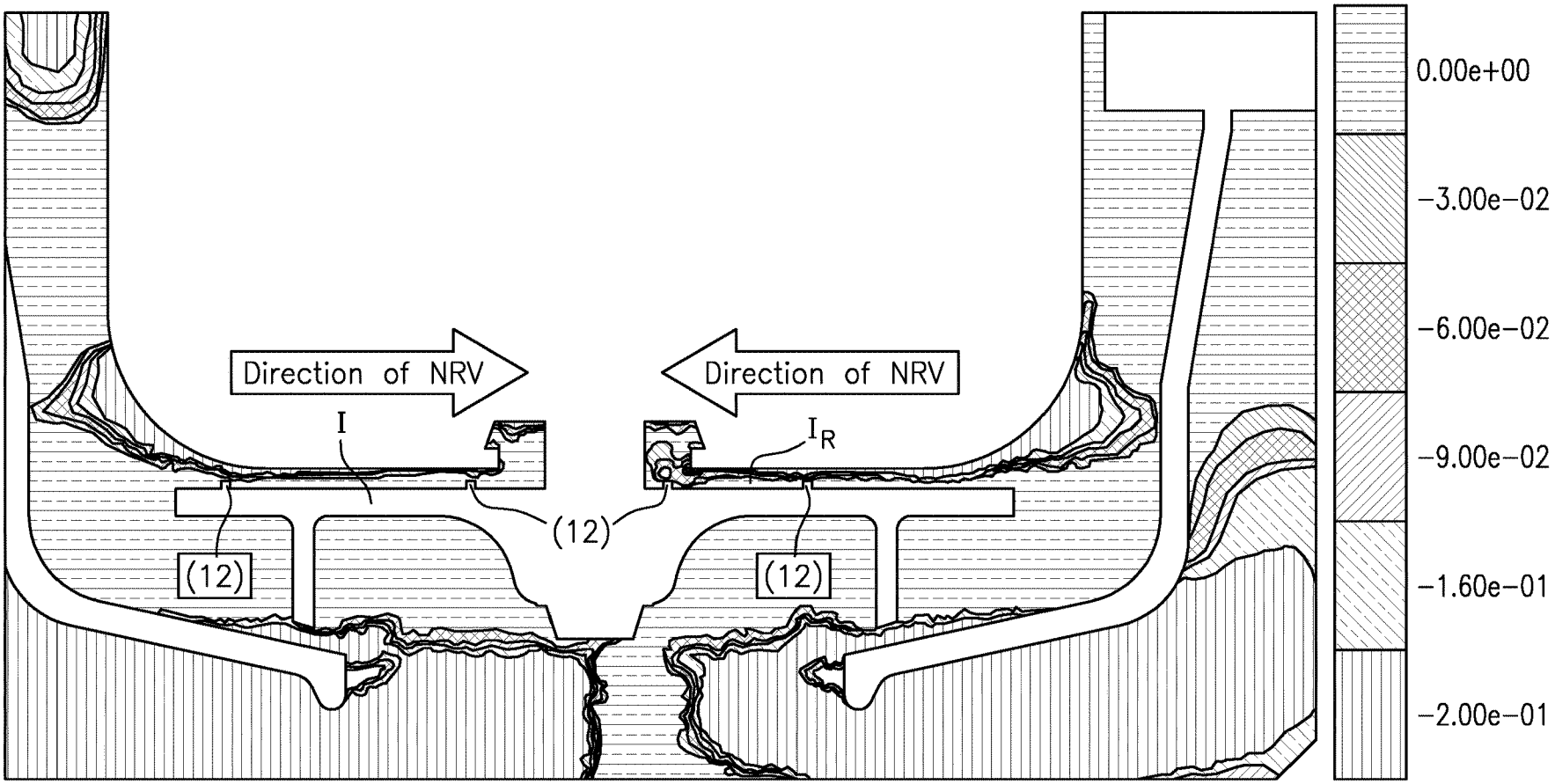
*FIG. 5B*: Case 2 (with spiral shaped back side vane V)
*FIG. 5*: Diagrams of negative radial velocity (NRV) on Section AA

*FIG. 6*: (Case 1)

*FIG. 7* (Case 2)

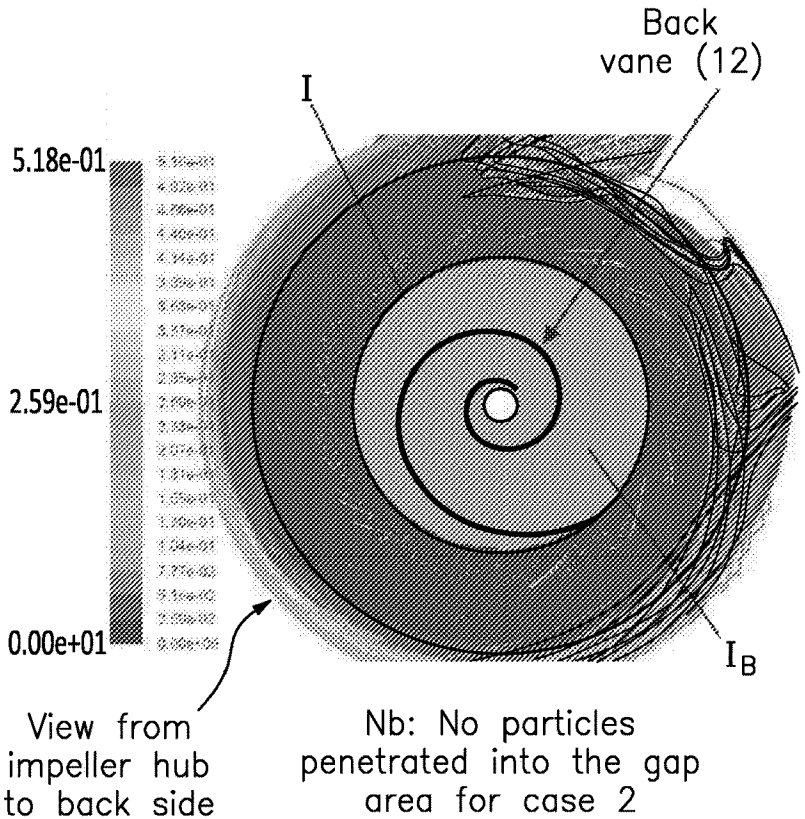
*FIG. 8B* (Case 2)
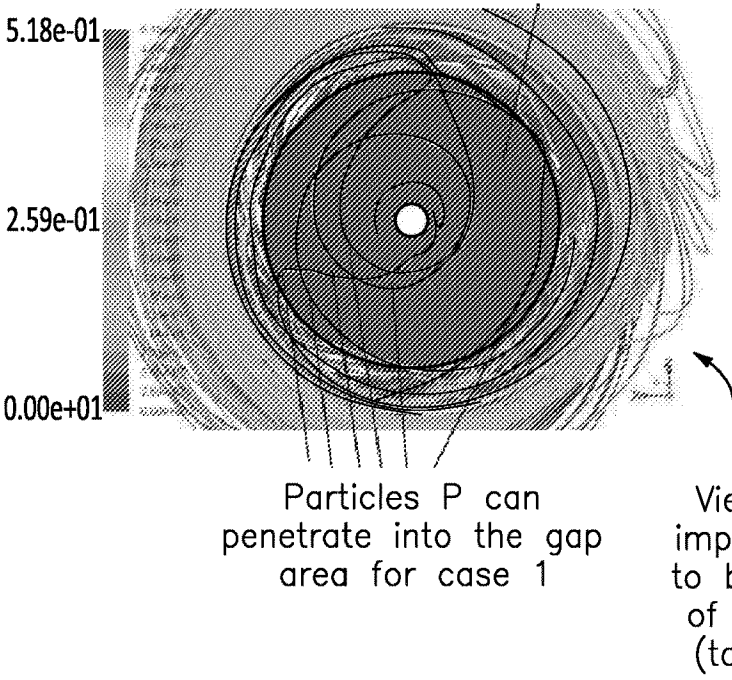
*FIG. 8A* (Case 1)
*FIG. 8*: Top view on the gap (900 particles total)

DEBRIS REMOVING IMPELLER BACK VANE

CROSS-REFERENCE TO RELATED APPLICATIONS

This application corresponds to international patent application serial no. PCT/US2014/043660, filed 23 Jun. 2014, which claims benefit to provisional patent application Ser. No. 61/837,753, filed 21 Jun. 2013, which is incorporated by reference in their entirety.

BACKGROUND OF THE INVENTION

1. Field of Invention

The present invention relates to a pump; and more particularly to a pump having an impeller with front and back sides.

2. Description of Related Art

In a typical centrifugal pump, fluid is accelerated through centrifugal forces exerted on it by an impeller. An impeller is a rotating disk driven by a motor whose front side has vanes extruding from it, which are used to transmit energy to the fluid being pumped. The rear or back side of the impeller is usually made as smooth as possible in order to reduce friction losses caused by the disk's rotation in the fluid being pumped. However, some shortcoming related to an impeller having a smooth rear or back side include the fact that debris can collect near the shaft seal and possibly cause pump jamming and failure of the shaft seal. Debris can also jam in between the backside of the impeller and the motor housing and cause the pump to lock up.

U.S. Pat. No. 5,489,187, entitled, "Impeller Pump With Vaned Backplate for Clearing Debris", discloses a set of stationary vanes added to the backplate of a seal chamber in a centrifugal pump to help clear the area of the seal chamber of entrained air bubbles and debris using the fluid motion created by the impeller. The '187 patent also discloses vanes on the back side of the impeller as a means to encourage the flow which runs over the stationary vanes. However, some shortcoming related to '187 impeller design include the fact that it relies on complex flow patterns to achieve its purpose. These patterns may be difficult and time consuming to predict and may vary from pump to pump. Also, the construction is composed of rotating and stationary vanes and debris can possibly get wedged between these two vanes and jam up the pump.

See also U.S. Pat. No. 5,019,136, which discloses a pump including an impeller having a backside with either rear straight radial vanes, or rear straight inclined vanes that are inclined rearwardly relative to the direction of rotation, or rear curved longer and shorter vanes curved rearwardly relative to the direction of rotation, or a combination of rear curved longer and shorter vanes curved rearwardly relative to the direction of rotation, e.g., also having gas discharge openings.

See also US 2012/0051897, which discloses a pump having a combination of a suction liner and an impeller, where the suction liner has curved vanes and the impeller has forward curved impeller suction side pump out vanes.

There is a need in the art for a pump having a better impeller design that overcomes the aforementioned problems with these known designs.

SUMMARY OF THE INVENTION

According to some embodiments, the present invention may take the form of an apparatus, including a pump, featuring an impeller configured as a rotating disk having a front side and a back side, the impeller being arranged to rotate on a shaft with the front side nearest an inlet and the back side nearest a motor housing, so as to provide a main flow of liquid being pumped and a rear impeller flow of the liquid being pumped in an area between the back side of the impeller and the motor housing, the back side comprising a spiral-shaped vane configured to constantly sweep, and expel any debris from, the area between the back side of the impeller and the motor housing, the spiral-shaped vane being formed as a curve that emanates from a central point or axis of the impeller and gets progressively farther away as the curve revolves at least one complete revolution around the central point or axis.

The present invention may also include one or more of the following features:

In particular, and by way of example, the spiral-shaped vane may take the form of a logarithmic spiral-shaped vane which is added to the backside of an impeller that constantly sweeps an area between the back of the impeller and the motor housing forcing any debris which has entered out to the periphery of the impeller where it is expelled through the outlet along with the main flow. This helps to prevent the problems caused by debris collecting near the shaft seal and also jamming in between the back of the impeller and the motor housing.

The logarithmic spiral-shaped vane, e.g., being substantially defined by the equation:

$$r=e^{\theta/\tan(\beta)},$$

where the parameters r and theta (θ) are respectively the radius and azimuthal angle defined using a polar coordinate system having an origin at a center point of the impeller; and the parameter beta (β) is an angle perpendicular to which a force acting on the debris will be oriented relative to a line tangent to a circle centered at the center of the impeller and extending out to the point of contact between the vane and the debris.

The spiral-shaped vane may include, or takes the form of, a single curve that emanates from a central point or axis of the impeller and gets progressively farther away as the curve revolves more than 1½ times (over 540°) around the central point or axis.

The impeller may be configured to rotate about the center point in a direction of rotation, and the logarithmic spiral-shaped vane may include, or take the form of, a spiral that emanates from the central point and curves progressively farther away from the central point in an opposite direction from the direction of rotation.

The front face may include one or more vanes that are used to impart a force from the motor onto the liquid being pumped causing the liquid to flow.

The logarithmic spiral-shaped vane may provide a force that is substantially perpendicular, due to the construction of the logarithmic spiral-shaped vane from the aforementioned equation, that will be at the chosen angle relative to a line tangent to a circle drawn at any given radius at which the debris may come in contact with the vane.

The pump may include a shaft seal between the shaft and the pump housing.

The pump may be a centrifugal pump.

According to some embodiment, the pump may also include the pump housing and the motor housing, including where the pump housing has an inlet for receiving a liquid to be pumped and an outlet for providing the liquid to be pumped via the main flow, and where the motor housing is arranged in the pump housing and has a motor arranged therein with the shaft.

In contrast to the pump system described in the aforementioned '187 patent, the pump according to the present invention is capable, e.g., of relying on the logarithmic spiral-shaped vane as a primary source of removing debris and not as a source of increased flow. It also does not have, and is not required to have, stationary vanes, e.g., on the motor housing, which could potentially cause jamming of the pump if debris is caught between the stationary and moving vanes.

BRIEF DESCRIPTION OF THE DRAWING

The drawing includes FIGS. 1A-8, which are not necessarily drawn to scale, as follows:

FIG. 1A is a diagram of a typical centrifugal pump configuration that is known in the art.

FIG. 1B shows a diagram of a main flow (thick arrows) and a rear impeller flow (thin arrows) of the liquid being pumped in the centrifugal pump in FIG. 1A.

FIG. 1C includes FIGS. 1C(1) and 1C(2) showing diagrams of a typical impeller that is known in the art, including where FIG. 1C(1) shows a diagram of a front side of a typical impeller, e.g., having front impeller vanes, and where FIG. 1C(2) shows a diagram of a smooth back side of the typical impeller, e.g., having front impeller vanes.

FIG. 2 is a diagram of an impeller having a rear impeller vane having a logarithmic spiral shape, according to some embodiments of the present invention.

FIG. 3 is a diagram of action of a rear impeller vane having a logarithmic spiral shape on debris, according to some embodiments of the present invention.

FIG. 4 shows a pump P having a pump housing PH with a plane section labelled A-A, indicated for the purpose of discussing results of a computational fluid dynamics (CFD) simulation of sand penetration into a gap between an impeller outer hub wall and a volute hub wall in relation to a first case of an impeller having a back side without a vane and a second case of an impeller having a back side with a spiral-shaped vane according to some embodiments of the present invention.

FIG. 5 includes FIGS. 5A and 5B, which show diagrams with negative radial velocities in relation to the plane section A-A in FIG. 4—where FIG. 5A is a diagram of a negative radial velocity in relation to the plane section A-A in FIG. 4 for the first case of the impeller having the back side without the vane; where FIG. 5B is a corresponding diagram of a corresponding negative radial velocity in relation to the plane section A-A in FIG. 4 for the second case of the impeller having the back side with the spiral-shaped vane according to some embodiments of the present invention; and where FIGS. 5A and 5B each include a vertical index bar having 20 boxes with grey scale shading and 21 associate negative velocities from $0.00e^{+00}$ (top), −1.00e02, −2.00e02, −3.00e02 . . . −9.00e02, −1.00e01, −1.10e01, −1.20e01, −1.30e01, . . . ,−1.90e01, and −2.00e01 (bottom) corresponding to the boxes with grey scale shading (with 2.00e01 (bottom) corresponding to the bottom box with grey scale shading), where the numbers are written in scientific E notation.

FIG. 6 includes FIGS. 6A and 6B, which show diagrams with sand concentrations on section AA in FIG. 4—where

FIG. 7 includes FIGS. 7A and 7B, which show diagrams with sand concentrations in the gap between the impeller outer hub wall and the volute hub wall on section AA in FIG. 4—where

FIG. 8 includes FIGS. 8A and 8B, which show diagrams of particles Ps traced by particle residence time in the gap between the impeller outer hub wall and the volute hub wall on section AA in FIG. 4—where FIG. 8A shows a diagram of particles traced by particle residence time for the first case of the impeller having the back side without the vane; where FIG. 8B shows a diagram of particles traced by particle residence time for the second case of the impeller having the back side with the spiral-shaped vane according to some embodiments of the present invention; and where FIGS. 8A and 8B each include a vertical index bar having 20 boxes with grey scale shading and 21 associate particle reference time from 5.18e-01 (top), 4.92e-01, 4.66e-01, 4.40e-01, . . . , 1.04e-01, 7.77e-02, 5.18e-02, 2.59e-02, and 0.00e-00 (bottom) corresponding to the boxes with grey scale shading (with 0.00e-01 (bottom) corresponding to the bottom box with grey scale shading).

DETAILED DESCRIPTION OF BEST MODE OF THE INVENTION

FIGS. 1A to 1C (Prior Art)

Figure 6A:
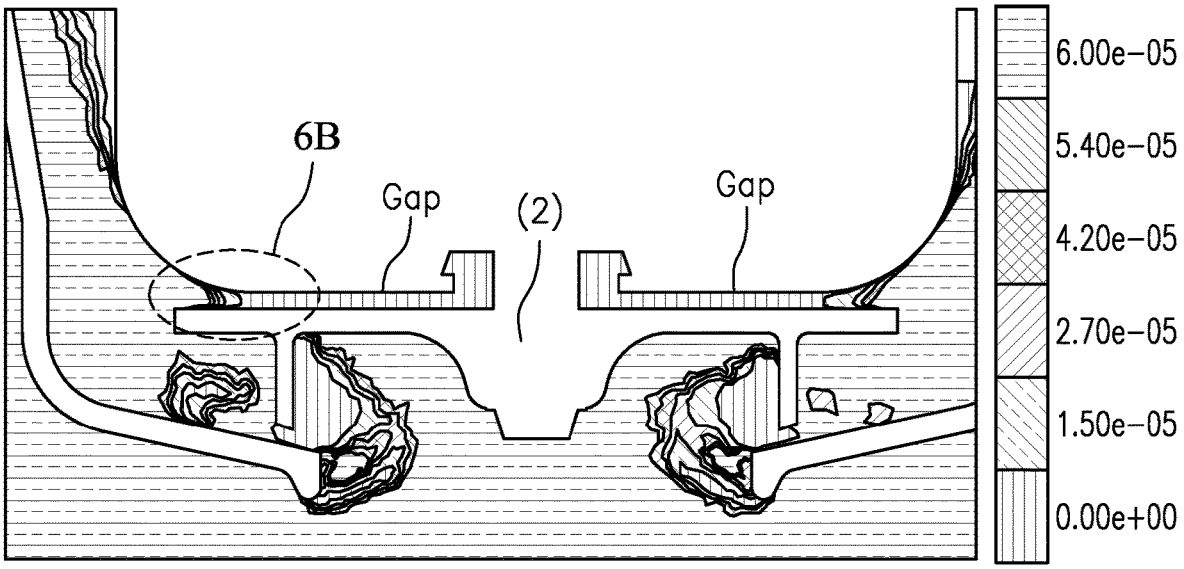
FIG. 6A shows a diagram of sand concentrations in the gap between the impeller outer hub wall and the volute hub wall on section AA in FIG. 4 for the first case of the impeller having the back side without the vane; where

FIGS. 1A to 1C show a typical centrifugal pump configuration, where liquid enters through an inlet (1) of a pump housing (20) and is accelerated by an impeller (2) to its periphery due to centrifugal forces caused by the rotation of the impeller (2) from the action of a motor shaft (6) which is driven by a motor (5) arranged in a motor housing (9). A main flow (7) of the liquid exits through an outlet (4) of the pump housing (10). Some of the liquid being pumped forms part of a rear impeller flow (8) that flows around to the back side (11) of the impeller (2) towards a shaft seal (3) before rejoining the main flow (7), consistent with that shown in FIG. 1B.

Debris suspended in the main flow (7) can be carried by the rear impeller flow (8) and become lodged in the space between the back (11) of the impeller (2) and the motor housing (9) causing pump lock up and failure.

By way of example, FIG. 1C shows the front and back of a typical impeller. The front of the impeller consists of one or more vanes (10) which are used to impart the force from the motor onto the liquid and cause it to flow. The back or backside of the typical impeller is smooth (11).

Observation has shown that pumps, e.g., like that shown in FIGS. 1A to 1C, having impellers without back vanes jammed up and stopped pumping several times. Heavy scratches were also observed from the debris on the back side of the impeller and on the motor housing area.

FIGS. 2-3

Consistent with that shown in FIGS. 2-3, the whole thrust of the present invention is to expel any debris which enters the area of the rear impeller flow (e.g., see reference label (8) in FIG. 1B) through the addition of a spiral-shaped vane (12), e.g., being formed as a curve that emanates from a central point or axis c of an impeller I and gets progressively farther away as the curve (12) revolves at least one complete revolution (360°) around the central point or axis c.

According to some embodiments of the present invention, and by way of example, the spiral-shaped vane (12) may include, or take the form of, a logarithmic spiral-shaped vane (12) on the back $I_B$ of the impeller I, e.g., whose geometry may be defined by the equation:

$$r=e^{\theta/\tan(\beta)},$$

where the parameters r and theta (θ) are the radius and azimuthal angle defined using a polar coordinate system whose origin is at the central point, center or axis c of the impeller I and beta (β) is the angle perpendicular to which the force (as shown and labeled in FIG. 3) acting on the debris will be oriented relative to a line tangent to a circle centered at the center of the impeller and extending out to the point of contact between the vane and the debris.

FIG. 2 shows the back $I_B$ of the impeller I in which the present invention has been implemented and the logarithmic spiral-shaped vane (12) is in place. In FIG. 2, the spiral-shaped vane (12) is configured as, or takes the form of, a single curve that emanates from the central point or axis c of the impeller I and gets progressively farther away as the curve (12) revolves about 630° (i.e., 1 and ¾ revolutions) around the central point or axis c. In FIGS. 2-3, by way of example, the spiral-shaped vane (12) is shown as a single curve, although the scope of the invention is not intended to the number of such spiral-shaped vanes used.

FIG. 3 shows a force (indicated by the associated arrow) that will be acting upon any debris which comes in contact with the rear spiral-shaped vane (12), according to some embodiments of the present invention. This force will be perpendicular (as shown in FIG. 3) to the logarithmic spiral-shaped vane (12) which, e.g., due to its construction from the aforementioned equation, will be at the chosen angle, e.g., beta (β), relative to a line T tangent to a circle C centered at the center of the impeller I and drawn at any given radius r at which the debris may come in contact with the logarithmic spiral-shaped vane (12), and extending out to the point of contact between the logarithmic spiral-shaped vane (12) and the debris, consistent with that shown in FIG. 3.

By way of example, the impeller I in FIGS. 2-3 may be exchanged with or replace the impeller (2) shown in FIGS. 1A to 1C for implementing at least one embodiment of the present invention.

In contrast to the observation set forth above, a similar observation has shown that pumps having impellers with spiral-shaped back vanes according to the present invention were able to pass all of the debris through without jamming up and no damage was observed on the back of the impeller or on the motor housing after the testing. For these reasons, pumps, e.g., like that disclosed in relation to FIGS. 2-3, appear to provide an important improvement over pumps, e.g., like that shown in FIGS. 1A to 1C.

Logarithmic Spiral, Equiangular Spiral or Growth Spiral

As a person skilled in the art would appreciate, a logarithmic spiral, equiangular spiral or growth spiral is a self-similar spiral curve, e.g., which often appears in nature. Consistent with definitions known in mathematics, a self-similar object is generally understood to be exactly or approximately similar to a part of itself (i.e. the whole has the same shape as one or more of the parts); a spiral is generally understood to be a curve (i.e., non-straight line) which emanates from a central point, getting progressively farther away as the curve revolves around the central point; and a curve (also called a curved line) is generally understood to be an object similar to a line but which is not required to be straight.

FIGS. 4-8: Example of CFD Simulation

By way of example, FIGS. 4-8 shows diagrams related to a computational fluids dynamics (CFD) simulation that was conducted of sand penetration into a gap between an impeller outer hub wall and a volute hub wall. In the CFD simulation, two pump geometries were analyzed: a case 1 for a pump geometery without a back vane impeller, and a case 2 for a pump geometry with a back vane (e.g., 10 degree angle). In the CFD simulation, a Fluent 14.5 code was used, and a turbulence k-w SST model was used with conditions, as follows:

A rotation speed of about 3450 rpm;

On the inlet, a water-sand mixture with about 2 kg/s of water and about 0.13 kg/s of sand; and Sand particles diameter was about 1 mm.

FIG. 4

FIG. 4 shows a pump P having a pump housing PH, an inlet and an outlet, along with a plane section labelled A-A, indicated for the purpose of discussing results of the CFD simulation of sand penetration into a gap between an impeller outer hub wall and a volute hub wall.

FIG. 5: Comparison of Negative Radial Velocity (NRV)

The CFD simulation resulted in the data shown in FIG. 5 having negative radial velocities in relation to the plane section A-A in FIG. 4 for case 1 (FIG. 5A) and case 2 (FIG. 5B).

In FIGS. 5A and 5B, the impeller is shown in the form of a white outline (no grey scale shading) and outlined by the grey scale shading. The spiral-shaped vane is indicated by four arrows labeled (12). In FIG. 5B, and by way of example, arrows shown the direction of NRV are shown, labeled accordingly and point towards the center or axis of the impeller labeled I.

From the diagrams in FIG. 5 one can see that the area with negative radial velocity on the gap for case1 is much larger compared with the corresponding area with negative radial velocity on the gap for case2, because the spiral-shaped back vane for case 2 significantly reduced the negative radial velocity area on the gap between the impeller outer hub wall and the volute hub wall.

FIGS. 6-7: Sand Concentration on Section A-A for Cases 1 and 2

FIGS. 6A, 6B, and FIGS. 7A, and 7B, show sand concentration in the gap between the impeller outer hub wall and the volute hub wall on section A-A section in FIG. 4 for case1 and case2 respectively.

Figure 6B:
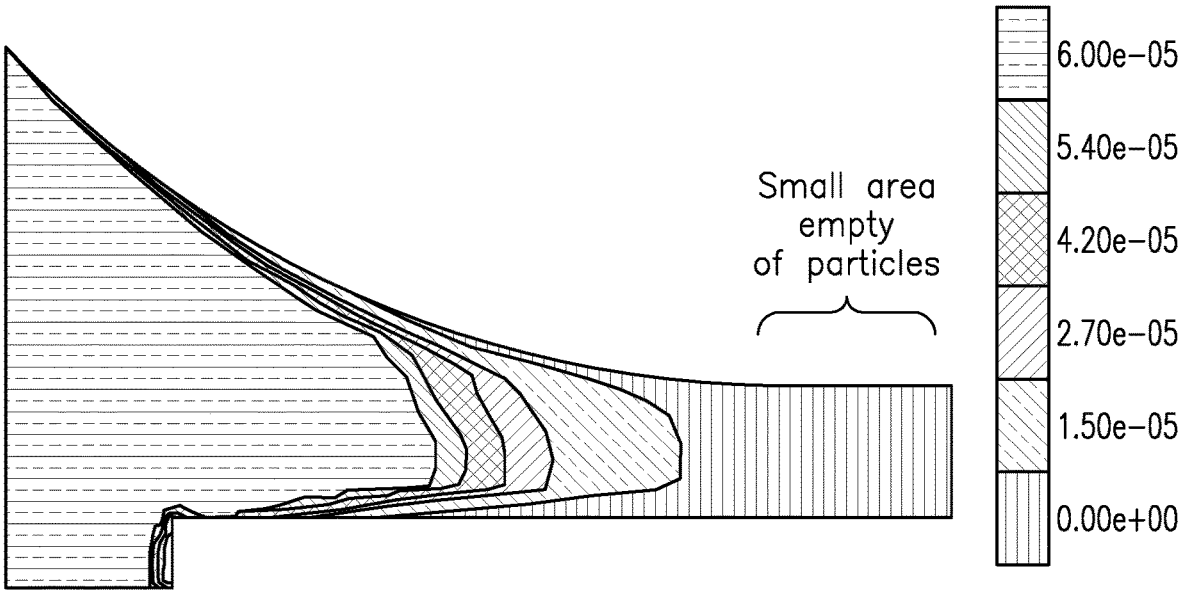
FIG. 6B shows an amplification zone of an oval-shaped part of the diagram in FIG. 6A; and where FIGS. 6A and 6B each include a vertical index bar having 20 boxes with grey scale shading and 21 associate concentrations from 6.00 e-05(top), 5.70-05, 5.40e-05, 5.10e-05, . . . , 1.20e-05, 9.00e-06, 6.00e-06⁻, 3.00e-06, and 0.00e-00 (bottom) corresponding to the boxes with grey scale shading (with 0.00e01 (bottom) corresponding to the bottom box with grey scale shading), where the numbers are written in scientific E notation.
Figure 7A:
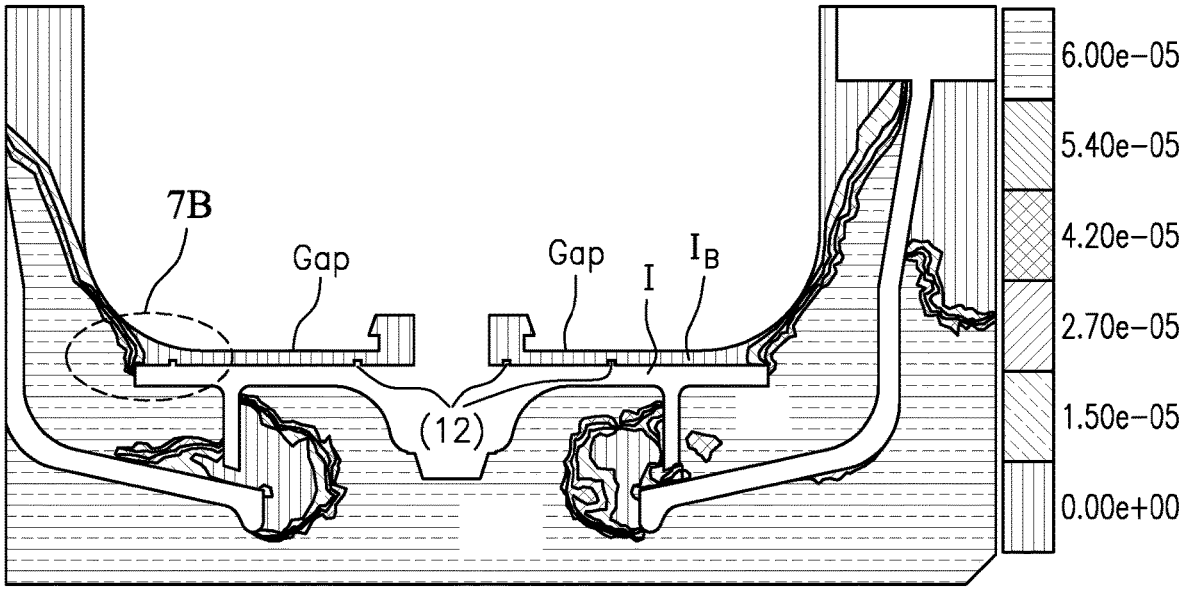
FIG. 7A shows a diagram of sand concentrations on section AA in FIG. 4 for the second case of the impeller having the back side with the spiral-shaped vane according to some embodiments of the present invention; where
Figure 7B:
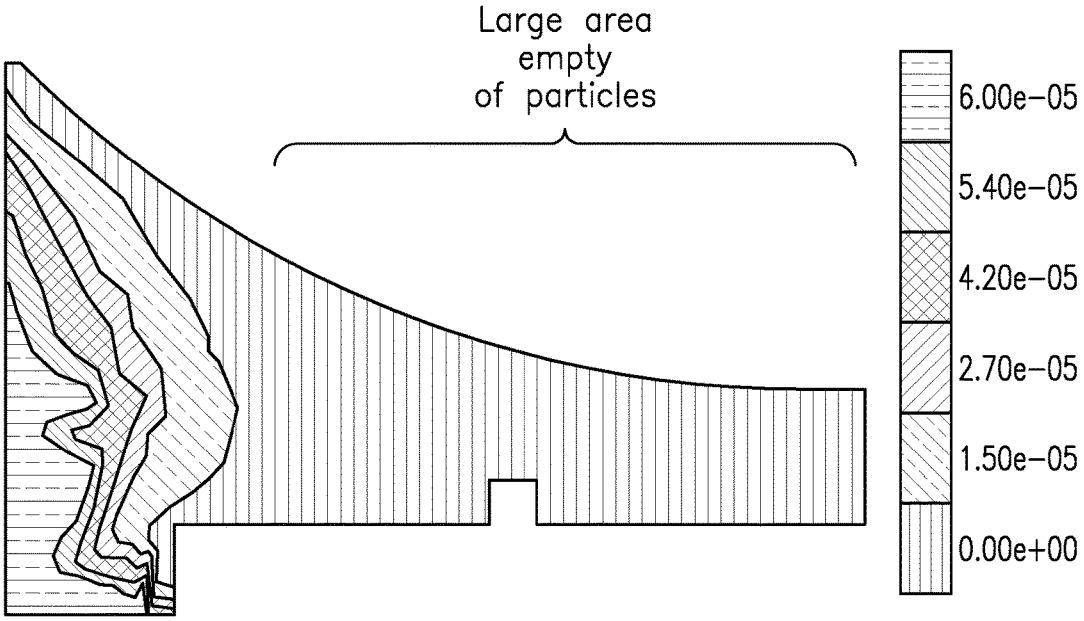
FIG. 7B shows an amplification zone of an oval-shaped part of the diagram in FIG. 7A; and where FIGS. 7A and 7B each include a vertical index bar having 20 boxes with grey scale shading and 21 associate concentrations from 6.00e-05 (top), 5.70e-05, 5.40e-05, 5.10e-05, . . . , 1.20e-05, 9.00e-06, 6.00e-06, 3.00e-06, and 0.00e-00 (bottom) corresponding to the boxes with grey scale shading (with 0.00e-01 (bottom) corresponding to the bottom box with grey scale shading) where the numbers are written in scientific E notation.

FIG. 6B is the amplification zone of the highlighted oval or eliptical region in the FIG. 6A; and FIG. 7B is the amplification zone of the highlighted oval or eliptical region in the FIG. 7*b*.

In FIGS. 6B and FIG. 7B, the areas empty of sand particles are indicated by associated braces and textual labeling. The clear difference between the size of the areas empty of sand particles in FIGS. 6B and 7B indicates that the back vane (case 2) prevents the penetration and concentration of more sand particles into the gap between the impeller outer hub wall and the volute hub wall.

FIG. 8

FIGS. 8A and 8B shows traces of particles, e.g., including in the gap between the impeller outer hub wall and the volute hub wall on section A-A section in FIG. 4 for case 1 and case 2 respectively. The particle traces are indicated by grey scale shading and traced by particles residence time. By way of example, the CFD simulation included about 900 particles total.

FIG. 8A shows and indicates particles that penetrated into the gap between the impeller outer hub wall and the volute hub wall for case 1 (without the spiral-shaped back vane).

In contrast, FIG. 8B shows and indicates no particles that penetrated into the gap between the impeller outer hub wall and the volute hub wall for case 2 (with the spiral-shaped back vane).

List Possible Applications:

Any centrifugal pump which uses an impeller and may be used in liquid containing debris.

The present invention may also be used in, or form part of, or used in conjunction with, any fluid handling application. The scope of the invention is also not intended to be limited to being implemented in any particular type or kind of pump either now known or later developed in the future, and may include centrifugal pumps, etc.

The Scope of the Invention

While the invention has been described with reference to an exemplary embodiment, it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiment(s) disclosed herein as the best mode contemplated for carrying out this invention.

What is claimed is:

1. An apparatus, including a pump, comprising:

an impeller configured as a rotating disk having a front side and a back side, the impeller being arranged to rotate on a shaft with the front side nearest an inlet and the back side nearest a motor housing of a motor, so as to provide a main flow of liquid being pumped and a rear impeller flow of the liquid being pumped in an area between the back side of the impeller and the motor housing, the back side comprising a spiral-shaped vane configured to constantly sweep, and expel any debris from the area between the back side of the impeller and the motor housing, the spiral-shaped vane being formed as a curve that emanates from a center point defined by an axis of the impeller and gets progressively farther away as the curve revolves at least one complete revolution around the center point, the spiral-shaped vane being a logarithmic spiral-shaped vane substantially defined by the equation:

$$r=e^{\theta/tan(\beta)},$$

where the parameters r and theta (θ) are respectively the radius and azimuthal angle defined using a polar coordinate system having an origin at a center point of the impeller; and the parameter beta (β) is an angle perpendicular to which a force acting on the debris will be oriented relative to a line tangent to a circle centered at the center point of the impeller and extending out to a point of contact between the logarithmic spiral-shaped vane and the debris.

2. The apparatus according to claim 1, wherein the impeller rotates about the center point in a direction of rotation, and the logarithmic spiral-shaped vane has a spiral that emanates from the center point and curves progressively farther away from the center point in an opposite direction from the direction of rotation.

3. The apparatus according to claim 1, wherein the front side comprises one or more vanes that are used to impart a force from the motor onto liquid being pumped causing the liquid to flow.

4. The apparatus according to claim 1, wherein the logarithmic spiral-shaped vane provides a force that is substantially perpendicular, due to the shape of the logarithmic spiral-shaped vane from the equation, that will be at an angle relative to a line tangent to a circle drawn at any given radius at which the debris may come in contact with the logarithmic spiral-shaped vane.

5. The apparatus according to claim 1, wherein the apparatus is a pump that comprises:

a pump housing having an inlet configured to receive liquid to be pumped and an outlet configured to provide the liquid to be pumped via the main flow; and a motor housing arranged in the pump housing having the motor arranged therein with a shaft.

6. The apparatus according to claim 5, wherein the pump is a centrifugal pump.

7. An apparatus, including a pump, comprising:

an impeller configured as a rotating disk having a front side and a back side, the impeller being arranged to rotate on a shaft with the front side nearest an inlet and the back side nearest a motor housing of a motor, so as to provide a main flow of liquid being pumped and a rear impeller flow of the liquid being pumped in an area between the back side of the impeller and the motor housing, the back side comprising a logarithmic spiral-shaped vane configured to constantly sweep, and expel any debris from the area between the back side of the impeller and the motor housing, the logarithmic spiral-shaped vane being substantially defined by the equation:

$$r=e^{\theta/tan(\beta)},$$

where the parameters r and theta (θ) are respectively the radius and azimuthal angle defined using a polar coordinate system having an origin at a center point defined by an axis of the impeller; and the parameter beta (β) is an angle perpendicular to which a force acting on the debris will be oriented relative to a line tangent to a circle centered at the center point of the impeller and extending out to a point of contact between the logarithmic spiral shaped vane and the debris.

8. The apparatus according to claim 7, the logarithmic spiral-shaped vane comprises a single curve that emanates from the center point of the impeller and gets progressively farther away as the single curve revolves at least one complete revolution around the center point.

9. The apparatus according to claim 7, wherein the impeller rotates about the center point in a direction of rotation, and the logarithmic spiral-shaped vane has a spiral that emanates from the center point and curves progressively farther away from the center point in an opposite direction from the direction of rotation.

10. The apparatus according to claim 7, wherein the front side comprises one or more vanes that are used to impart a force from the motor onto liquid being pumped causing the liquid to flow.

11. The apparatus according to claim 7, wherein the logarithmic spiral-shaped vane provides a force that is substantially perpendicular, due to the shape of the logarithmic spiral-shaped vane from the equation, that will be at an angle relative to a line tangent to a circle drawn at any given radius at which the debris may come in contact with the logarithmic spiral-shaped vane.

12. The apparatus according to claim 7, wherein the apparatus is a pump that comprises:

a pump housing having an inlet configured to receive liquid to be pumped and an outlet configured to provide the liquid to be pumped via the main flow; and a motor housing arranged in the pump housing having the motor arranged therein with a shaft.

13. The apparatus according to claim 12, wherein the pump is a centrifugal pump.

14. A centrifugal pump comprising:

a pump housing having an inlet configured to receive liquid to be pumped and an outlet configured to provide the liquid to be pumped via a main flow;

a motor housing arranged in the pump housing having a motor arranged therein with a shaft; and an impeller configured as a rotating disk having a front side and a back side, the impeller being arranged to rotate on the shaft with the front side nearest the inlet and the back side nearest the motor housing, so as to provide the main flow of the liquid being pumped and a rear impeller flow of the liquid being pumped in an area between the back side of the impeller and the motor housing, the back side comprising a logarithmic spiral-shaped vane configured to constantly sweep, and expel any debris from the area between the back side of the impeller and the motor housing, the logarithmic spiral-shaped vane being substantially defined by the equation:

$$r=e^{\theta/\tan(\beta)},$$

where the parameters r and theta (θ) are respectively the radius and azimuthal angle defined using a polar coordinate system having an origin at a center point defined by an axis of the impeller; and the parameter beta (β) is an angle perpendicular to which a force acting on the debris will be oriented relative to a line tangent to a circle centered at the center point of the impeller and extending out to a point of contact between the logarithmic spiral-shaped vane and the debris.

15. The centrifugal pump according to claim 14, wherein the spiral-shaped vane comprises a single curve that emanates from the center point of the impeller and gets progressively farther away as the single curve revolves more than 1½ times (over 540°) around the center point.

16. The centrifugal pump according to claim 14, wherein the impeller rotates about the center point in a direction of rotation, and the logarithmic spiral-shaped vane has a spiral that emanates from the center point and curves progressively farther away from the center point in an opposite direction from the direction of rotation.

17. The centrifugal pump according to claim 14, wherein the front side comprises one or more vanes that are used to impart a force from the motor onto the liquid being pumped causing the liquid to flow.

18. The centrifugal pump according to claim 14, wherein the logarithmic spiral-shaped vane provides a force that is substantially perpendicular, due to the shape of the logarithmic spiral-shaped vane from the equation, that will be at an angle relative to a line tangent to a circle drawn at any given radius at which the debris may come in contact with the vane.

19. The centrifugal pump according to claim 14, wherein pump comprises a shaft seal between the shaft and the pump housing.

* * * * *